US006323593B1

(12) United States Patent
Anderson et al.

(10) Patent No.: US 6,323,593 B1
(45) Date of Patent: Nov. 27, 2001

(54) PRODUCT AND PROCESS FOR NEON LAMP

(75) Inventors: James Gary Anderson, Dundee; Edwin Quentin Giles, Beaver Dams; Albert Mijo Gossie, Hammondsport, all of NY (US); Gilbert Dominique Pujol, Dammarie les Lys (FR); Jackson Phelps Trentelman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/367,193

(22) PCT Filed: Feb. 19, 1998

(86) PCT No.: PCT/US98/03282

§ 371 Date: Aug. 6, 1999

§ 102(e) Date: Aug. 6, 1999

(87) PCT Pub. No.: WO98/39792

PCT Pub. Date: Sep. 11, 1998

Related U.S. Application Data

(60) Provisional application No. 60/038,891, filed on Feb. 19, 1997.

(51) Int. Cl.[7] ..... H01J 61/30

(52) U.S. Cl. ..... 313/493; 313/113; 313/114; 313/117; 313/513

(58) Field of Search ..... 313/493, 113, 313/114, 634, 341, 117, 484, 513, 514, 612

(56) References Cited

U.S. PATENT DOCUMENTS

| | | | | |
|---|---|---|---|---|
| 3,508,103 | * | 4/1970 | Young | 313/493 |
| 5,834,888 | | 11/1998 | Allen et al. | 313/484 |
| 5,903,090 | * | 5/1999 | Haag | 313/113 |

FOREIGN PATENT DOCUMENTS

98/44528 10/1998 (WO) .

* cited by examiner

*Primary Examiner*—Nimeshkumar D. Patel
*Assistant Examiner*—Ken A Berck
(74) *Attorney, Agent, or Firm*—Christopher A. Gallo; Anca C. Gheorghiu; Patrick P. Pacella

(57) ABSTRACT

This discharge lighting device is directed to a high efficiency, long-life neon discharge lamp with a unique channel configuration.

9 Claims, 3 Drawing Sheets

PRODUCT AND PROCESS FOR NEON LAMP

This application claims the benefit of U. S. Provisional Application Ser. No. 60/038,891, filed Feb. 19, 1997 entitled PRODUCT AND PROCESS FOR NEON LAMP, by James G. Anderson, Edwin Q. Giles, Albert M. Gossie, Gilbert D. Pujol and Jackson P. Trentelman.

BACKGROUND OF THE INVENTION

This invention relates generally to the field of discharge lighting. In particular, it relates to discharge lighting with a unique channel configuration which, for reasons to be described herein, produces lamps which operate at high efficiency. They are particularly efficacious for the automotive and downlighting markets, to name just two.

Generally, there are two distinct types of lighting requirements, those in which direction of the light is relatively unimportant, and those in which the light must be directed in a particular manner subsequent to its generation. The present invention, while suitable for either application, is particularly well suited for the latter.

An example of the latter category is automotive lighting. After light is generated by the lamp, it must be focused/dispersed according to somewhat exacting standards. While the requirements for headlight sidemarkers, tail lights, brake lights, directionals, hazards, CHMSLs (center high-mounted stop lights), etc. are all different—they share the characteristic of needing to be directed in some specific manner.

Typically, these lights are constructed of a lamp element (for generating light) and a lens element (for directing the light). Lamp elements generally fall in to three categories: HID, incandescent, and discharge. Discharge lamps are generally characterized as having a sealed envelope filled with a gas which contains atoms/ions which emit light when excited.

Commonly assigned patent application Ser. No. 60/042,568 is directed to a discharge lamp formed by a plurality of glass layers with channels formed therebetween, the entirety of which is incorporated herein by reference. It teaches the desirability of forming a secondary gas-containing channel to act as a reservoir to replenish the gas in the primary channel (the discharge channel). That innovation allows for the lamp to operate at low pressure which is desirable for high light output while solving the long-known, life-reducing problem of sputtering.

Although that design is a tremendous improvement over the previous state of the art, it is not perfect. There exists a need to provide a lamp which possesses longer life with no trapped air.

As mentioned above, there has been recent interest in the use of neon discharge lamps for automotive use. Plaguing this application are problems of light focus, power requirements, and lamp life.

OBJECTS OF THE INVENTION

It is therefore an object of the invention to provide a high efficiency discharge lamp.

It is another object of the invention to provide a discharge lamp with extended life.

It is yet another object of the invention to provide a discharge lamp which will operate at low pressure.

It is a further object of the invention to provide a discharge lamp which contains essentially no trapped air.

It is another object of the invention to provide a discharge lamp which operates at low current.

It is an additional object of the invention to provide a discharge lamp with a high reservoir to discharge channel volume ratio.

It is another object of the invention to provide a discharge lamp with the maximum possible reservoir volume.

It is a further object of the invention to provide a discharge lamp with an internal reflector surface.

SUMMARY OF THE INVENTION

These and other objects can be achieved through the methods and products described herein. Specifically, applicants have developed a novel discharge lamp which operates at a higher efficiency than has been heretofore realized, through use of combination of a discharge channel in communication with a large reservoir. This configuration offers numerous improvements over the prior art lamps.

In a first aspect, the invention relates to a discharge lamp comprising:

a plurality of glass sheets;

a plurality of channels formed therebetween containing at least one discharge channel in communication with at least one reservoir channel; and a plurality of support pillars.

In another aspect, the invention relates to a discharge lamp in which at least one reservoir channel comprises all available glass surface area which is not being used for discharge channels or support pillars.

In an additional aspect, the invention relates to a long-life discharge lamp which operates at low pressures.

In yet another aspect, the invention relates to a discharge lamp with a high reservoir volume to discharge volume ratio.

It is a farther aspect of the invention to provide a discharge lamp which contains essentially no trapped air.

It is an additional aspect of the invention to provide a discharge lamp which contains an internal reflector surface.

Figure 1:
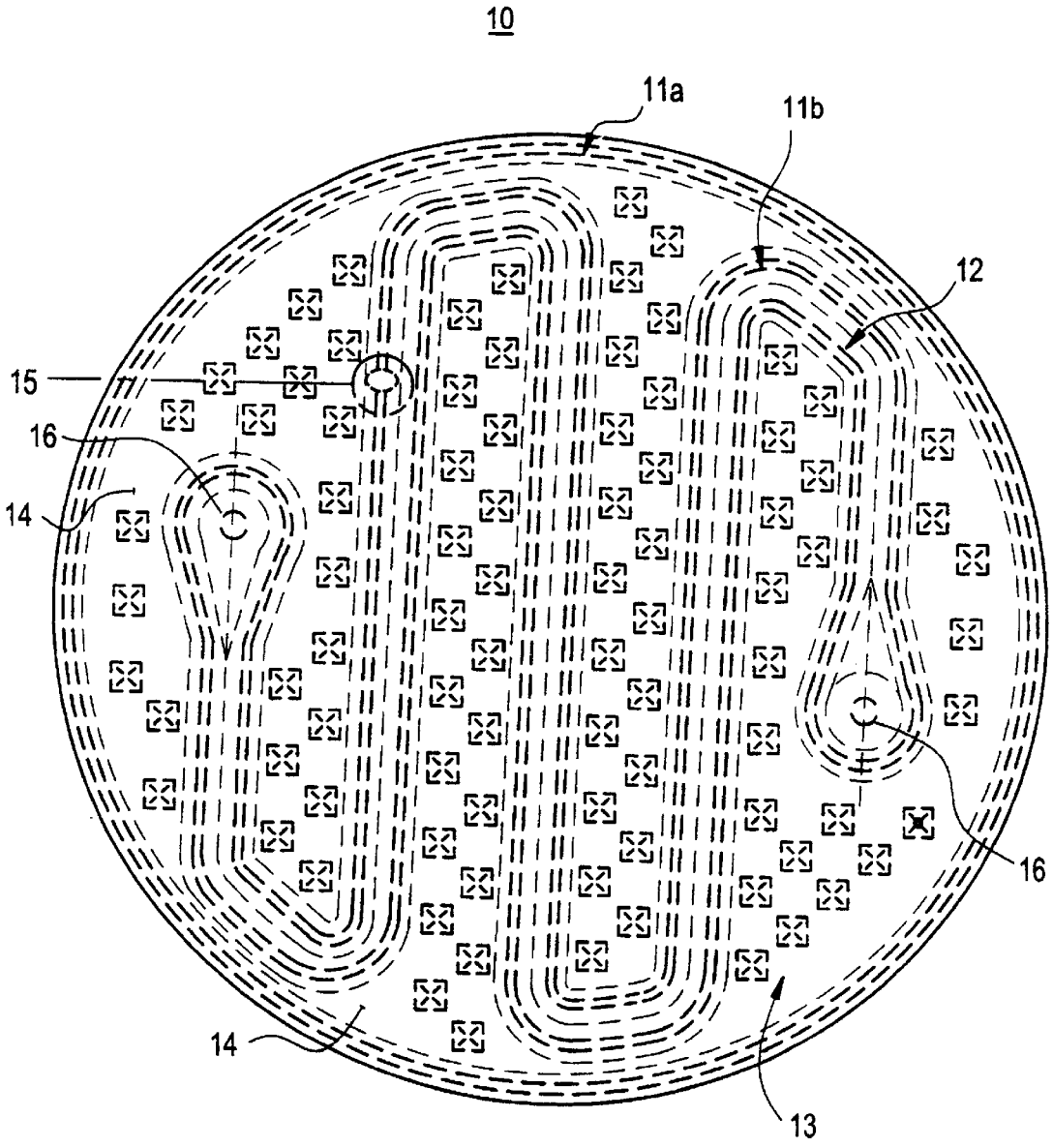
FIG. 1, is a top view of the discharge lamp of the invention.

The foregoing drawings, which constitute part of the specification, illustrate various embodiments of the invention and together with the description, serve to explain the principles of the invention. It is to be understood, of course, that both the drawings and the description are explanatory only and are not restrictive of the invention. The drawings are not intended to indicate scale or relative proportions of the elements shown therein.

DETAILED DESCRIPTION OF THE INVENTION

Applicant's invention will now be explained in greater detail. The description and embodiments will generally center around automotive applications, and neon-based automotive tail lighting to be specific. It should be noted however, that applicant's invention is broadly directed to a laminated discharge lamp and thus not limited to the specific embodiments described herein. For example, applicant's lamp may function as a fluorescent light source when used in combination with the proper internal coating and/or discharge gas. That embodiment would be especially well suited for the downlighting market.

Applicants have previously described a process for manufacturing a laminated internally channeled discharge lamp in U.S. Pa tent application Ser. No. 08/851,320 the entirety of which is incorporated herein by reference.

The glass article of the invention exhibits at least one internal or enclosed discharge channel i.e., a glass envelope. This channel possesses tubulation ports at the opposite ends of the channel, each communicating with the external environment. These tubulation ports are the sites where the internal/enclosed channel of the glass article may be evacuated and thereafter backfilled with neon or other inert gas. In addition to the discharge channel, a reservoir area is formed within the envelope. In order to complete the manufacture of the light-emitting device, traditional electrodes may be attached to these tubulation ports (or other sites where ports have been located) via a glass-to-glass seal once the glass article is evacuated and backfilled. Additionally, external electrodes (communicating capacitively or inductively with the channel) may be used. For example, the tubulation ports and glass enclosed electrodes may flame sealed together, i.e., the port and the glass enclosed electrode can be flame softened, coupled together and thereafter allowed to cool and subsequently seal together.

Additionally, the article could possess a plurality of discharge channels in a predetermined pattern each possessing at least a pair tubulation ports at the opposite ends of each respective channel.

In general, the instant method comprises the following steps: (a) delivering and depositing a first or channel-forming ribbon of molten glass to a surface of a mold assembly having a mold cavity area possessing at least one channel-forming groove formed therewithin and a peripheral surface area, wherein the channel-forming ribbon overlies the mold cavity area and the peripheral surface areas of the mold assembly; (b) causing the channel-forming ribbon of molten glass to substantially conform to the contour of the mold cavity resulting in the formation of at least one channel in the ribbon of the molten glass deposited; (c) delivering and depositing a second or sealing ribbon of molten glass to the outer surface of the channel-forming ribbon of molten glass wherein the viscosity of the sealing ribbon is such that the sealing ribbon (i) bridges but does not sag into complete contact with the surface of the channel of the channel-forming ribbon and (ii) forms a hermetic seal wherever the sealing ribbon contacts the channel-forming ribbon thereby resulting in a glass article possessing at least one enclosed channel; and, (d) removing the glass envelope from the mold.

The actual delivering of the glass ribbon, assuming a product exhibiting two layers requires the utilization of two separate glass delivery orifices. In the case of products that could be made from narrow ribbon, i.e., a ribbon size of up to about 10" wide, a simple round orifice would be sufficient. On the other hand, if thin products are to be produced, exhibiting a thickness of up to about 0.1", a near "net shape" delivery system is preferable; i.e., using an orifice which exhibits a high aspect ratio similar to the product itself. For instance, a slotted-type orifice could deliver molten glass exhibiting a thermal uniformity which would ultimately result in glass articles of the best quality.

The mold assembly has a predetermined shape possessing the proper design necessary to result in product which meets desired final product specification, i.e., a distribution of grooves, indentations, holes, inserts and peripheral edges to form the channels, sealing areas and support pillars. Additionally, it is self evident that the shape and configuration of the groove design imparted to the mold determines the form and pattern of the so-formed glass article and ultimately the neon lighting device formed therefrom.

In an alternative embodiment the internal surface of the first channel forming ribbon forms a reflector surface.

In the instant invention, applicants begin with the same basic process but configures the mold surface such that numerous pillars are formed in the first sheet along with the discharge channel cavity. When the second glass ribbon is deposited thereon, a discharge channel is formed. In addition, the support pillars form a series of points to support the second glass sheet, thus allowing the bulk of the non-discharge channel surface area to be available as a reservoir channel. This configuration allows for reservoir volume to discharge channel volume ratios of greater than heretofore achievable. In one embodiment the ratio of reservoir volume to discharge volume is greater than 5:1. In a preferred embodiment the ratio is greater than 10:1.

Referring now to FIG. 1 lamp 10 is shown in top view. The double dashed lines 11 represent points at which the first and second glass sheets are sealed together. Lines 11*a* represent the outer seal of the lamp, while lines 11*b* represent the seals that form the discharge channel 12 therebetween.

The plurality of points 13 represent the "tops" of the pillars which are formed in the first sheet to support the second sheet. The open area surrounding the pillars forms the reservoir 14.

Open areas 16 are located at opposite ends of channel 12 to form tubulation ports (not shown) to allow for communication with the outside world, for gas-filling, evacuation, or electrode mounting, or any of the three.

Figure 2A:
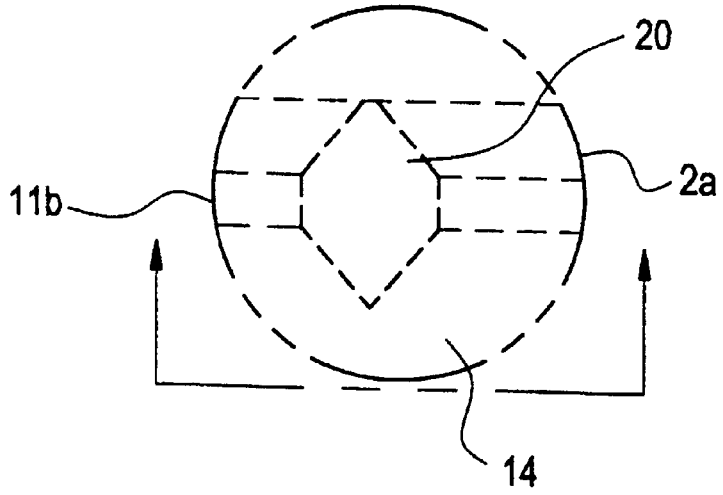
FIG. 2*a* is a magnified top section of the discharge lamp.
Figure 2B:
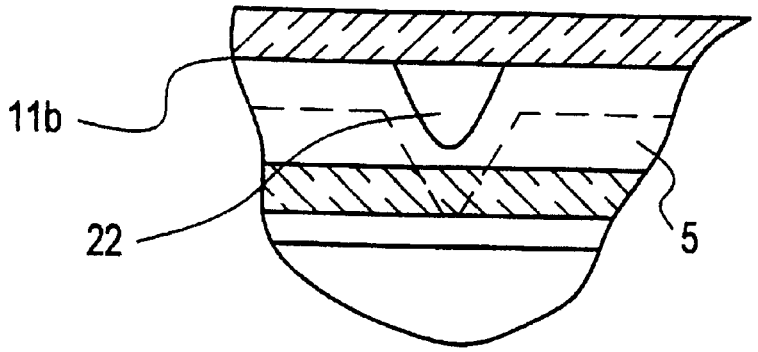
FIG. 2*b* is a cross sectional view of the communication portion of the discharge lamp.

FIG. 2*a* is a magnified top section taken at point 15 of FIG. 1. It is at this point that discharge channel communicates with reservoir 14 through opening 20 in the seal 11*b*. FIG. 2*b* further illustrates the opening in seal 11*b* by showing an indentation 22 in the first glass sheet 5.

Figure 3A:
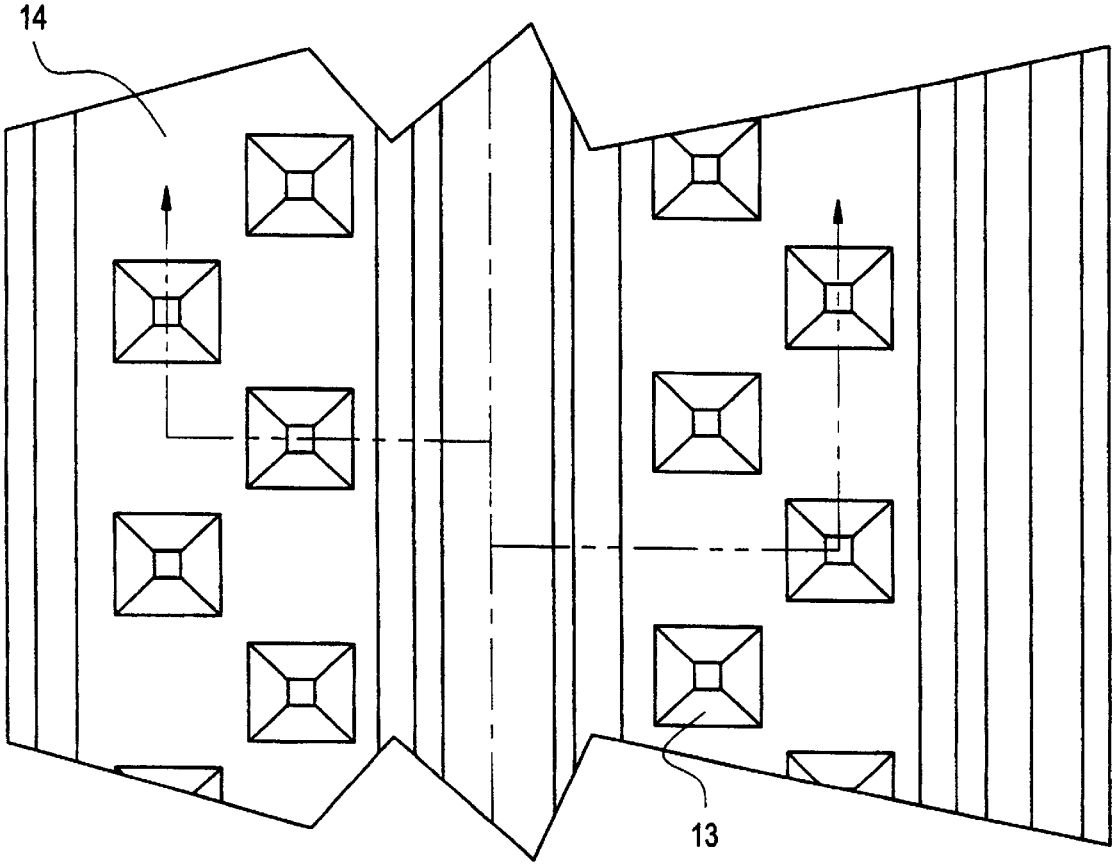
FIG. 3*a* is a cutaway top view of the discharge lamp of the invention.
Figure 3B:
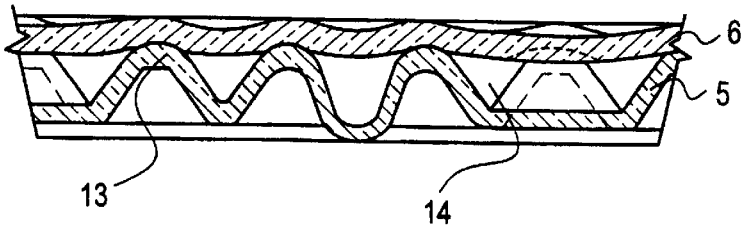
FIG. 3*b* is a cross sectional view of a portion of the discharge lamp.

FIG. 3*a* shows several of the support pillars 13. FIG. 3*b* shows the cross section indicated on 3*b*. As can be seen, the pillars 13 are formed in the first glass sheet 5 to support the second glass sheet 6 in the large volume reservoir areas 14.

As mentioned previously and shown in FIG. 3*b*, an alternative embodiment of the instant invention provides that the inner surface 25 of the first channel forming ribbon may be a reflective surface.

Having thus described the basic concept of the invention, it will be readily apparent to those skilled in the art that the foregoing detailed disclosure is intended to presented by way of example only, and applicants' do not mean to limit their invention thereto. Various alterations, improvements and modifications will occur and are intended to those skilled in the art, though not expressly stated herein. These modifications, alterations, and improvements are intended to be suggested hereby, and are within the spirit and scope of the invention. Accordingly, the invention is limited only by the following claims and equivalents thereto.

We claim:

1. A discharge lamp comprising:

a first channel forming glass sheet and a second sealing glass sheet forming a glass envelope; and a plurality of channels formed between said first channel forming glass sheet and said second sealing glass sheet, wherein said plurality of channels contains at least one discharge channel and at least one reservoir channel.

2. The discharge lamp of claim 1 wherein said at least one reservoir channel comprises all available glass surface area which is not being used for discharge channels.

3. The discharge lamp of claim 1 wherein said discharge channel is serpentine.

4. The discharge lamp of claim 1 wherein the reservoir volume to discharge channel volume ratio is greater than 5:1.

5. The discharge lamp of claim 1 wherein the reservoir volume to discharge channel volume ratio is greater than 10:1.

6. The discharge lamp of claim 1 wherein a reflective surface is provided on said first glass sheet which forms said discharge channel.

7. A discharge lamp according to claim 1 wherein said reservoir channel is in communication with said discharge channel for replenishing gas in said discharge channel.

8. A discharge lamp according to claim 1 including a plurality of support pillars formed in said first channel forming glass sheet to support said second sealing glass sheet.

9. A discharge lamp comprising:

a first channel forming glass sheet and a second sealing glass sheet forming a glass envelope;

a plurality of channels formed between said first channel forming glass sheet and said second sealing glass sheet, wherein said plurality of channels contains at least one discharge channel in communication with at least one reservoir channel, said reservoir channel for replenishing gas in said discharge channel; and a plurality of support pillars formed in a non-discharge channel surface area of said first channel forming glass sheet to support said second sealing glass sheet in said non-discharge channel surface area for forming said reservoir channel.

* * * * *